US010509367B2

(12) United States Patent
Alarcon

(10) Patent No.: US 10,509,367 B2
(45) Date of Patent: Dec. 17, 2019

(54) SKELETONIZED ELECTRONIC TOURBILLON SIMULATOR WITH REPEATER

(71) Applicant: Randy Alarcon, Cleveland, OH (US)

(72) Inventor: Randy Alarcon, Cleveland, OH (US)

( * ) Notice: Subject to any disclaimer, the term of this patent is extended or adjusted under 35 U.S.C. 154(b) by 121 days.

(21) Appl. No.: 15/950,349

(22) Filed: Apr. 11, 2018

(65) Prior Publication Data

US 2019/0317452 A1 Oct. 17, 2019

(51) Int. Cl.

| | |
|---|---|
| ***G04G 9/00*** | (2006.01) |
| ***G04B 45/02*** | (2006.01) |
| ***G04B 17/28*** | (2006.01) |

(52) U.S. Cl.

CPC ..... *G04B 45/02* (2013.01); *G04B 17/285* (2013.01); *G04G 9/0088* (2013.01); *G04G 9/0094* (2013.01)

(58) Field of Classification Search

CPC ..... G04G 9/00; G04G 9/0088; G04G 9/0094; G04B 45/02; G04B 17/285; G04B 17/28

See application file for complete search history.

(56) References Cited

U.S. PATENT DOCUMENTS 5,748,568 A * 5/1998 Harrison ..... G04G 9/0094 368/223
8,534,910 B2 * 9/2013 Baudet ..... G04C 5/005 368/126
9,082,314 B2 * 7/2015 Tsai ..... G09B 19/12
2012/0182841 A1 * 7/2012 De Belder ..... G04G 9/04 368/240
2012/0269043 A1 * 10/2012 Baudet ..... G04C 3/047 368/126
2013/0039156 A1 * 2/2013 Lin ..... G04C 17/0091 368/228
2015/0117162 A1 * 4/2015 Tsai ..... G09B 19/12 368/29
2016/0004276 A1 * 1/2016 Stroetmann ..... G04G 9/007 361/679.03
2018/0181073 A1 * 6/2018 Tombez ..... G04C 11/084

* cited by examiner

*Primary Examiner* — Sean P Kayes
(74) *Attorney, Agent, or Firm* — Daniel M. Cohn; Howard M. Cohn

(57) ABSTRACT

An electronic tourbillion clock including a clock case having a plurality of high-resolution digital displays that extend around an outer circumference of the clock case as an indicator of hours. A seven segment display is located within the clock case as an indicator of minutes elapsed within an hour. A microcontroller determines the current time and other chronological indications depending on the output signals generated by a position of a tourbillon mechanism disposed in the clock case. A sub-circuit is disposed within the clock case and interconnected with the microcontroller for creating a plurality of distinctive sound patterns directed through one or more speakers in response to the output signals generated by the position of the tourbillon mechanism.

20 Claims, 7 Drawing Sheets

SKELETONIZED ELECTRONIC TOURBILLON SIMULATOR WITH REPEATER

TECHNICAL FIELD OF THE INVENTION

The present invention relates to an electronic tourbillion clock. More specifically, the invention is directed to an electronic tourbillion clock with a repeater.

BACKGROUND OF THE INVENTION

Clocks and watches can be classified into two main families depending on the type of movement used. Electronic clocks and watches, most often regulated by a quartz crystal, have the advantage of great accuracy and moderate cost thanks to industrial manufacturing technology. The time calculated by electronic clocks and watches is most often displayed in digital fashion on a liquid crystal segment display or sometimes by means of hands driven by a stepping motor whose running is regulated by the quartz. Liquid crystal segment displays have the disadvantage of a limited contrast making it uncomfortable to read the digital symbols formed by the segments, notably in low ambient light. Stepping motors generally cause a jerky displacement of the hands, considered unquiet and not representative of the continuous passing of time.

Mechanical movements make it possible to display the time by means of hands or other indicators moving in near-continuous manner whilst making the reading comfortable, even when the ambient light is low. Furthermore, the extraordinary ingenuity of some mechanical movements and the possibility of showcasing their components is considered fascinating by many users, notably in the case of skeleton watches that enable parts of the movement to be admired through the watch crystal and the dial. Mechanical watches thus generate considerable interest and there is an established commercial need for mechanical watches with a dial animated by the elements of the movement in motion.

The manufacture of mechanical movements, however, is complex, so that mechanical movements are generally more expensive than electronic movements. This is in particular the case of mechanical movements with grand complications or when the movement needs to be decorated or machined so as to be permanently visible behind the clock and watch crystal. Mechanical clocks and watches displaying their complications are thus almost exclusively reserved to the upper segment of the luxury clock and watch market. Furthermore, only a small proportion of the potentially interested customers can avail themselves of the mechanical clock and watch collection that is required in order to appreciate the multitude of different complications proposed by the clock and watchmakers.

SUMMARY OF THE INVENTION

According to an embodiment of the present invention, there is disclosed an electronic tourbillion clock. The electronic tourbillion clock includes a clock case having a plurality of high-resolution digital displays that extend around an outer circumference of the clock case as an indicator of hours. A seven segment display is located within the clock case as an indicator of minutes elapsed within an hour. A microcontroller determines the current time and other chronological indications depending on the output signals generated by a position of a tourbillon mechanism disposed in the clock case. A sub-circuit is disposed within the clock case and interconnected with the microcontroller for creating a plurality of distinctive sound patterns directed through one or more speakers in response to the output signals generated by the position of the tourbillon mechanism.

According to another embodiment of the present invention, there is disclosed a method of operating an electronic tourbillion clock. The method includes rotating a tourbillion mechanism in a clockwise direction, and simultaneously rotating an extended pointer mounted to the tourbillion mechanism in a clockwise direction. Then, detecting a change in distance within a proximity sensor from the extended pointer to the proximity sensor and directing a signal to a seven segment display. Increasing a number generated on the seven segment display by one minute increments in response to the signal directed by the proximity sensor to the seven segment display. Then, triggering a change in a bulb display by one hour increments whenever the seven segment display reaches a 00 reading. Finally, creating a plurality of distinctive sound patterns and directing the sound patterns through one or more speakers in response to output signals generated by a sub-circuit, interconnected with a microcontroller mounted within the electronic tourbillion clock.

BRIEF DESCRIPTION OF THE DRAWINGS

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

Figure 1:
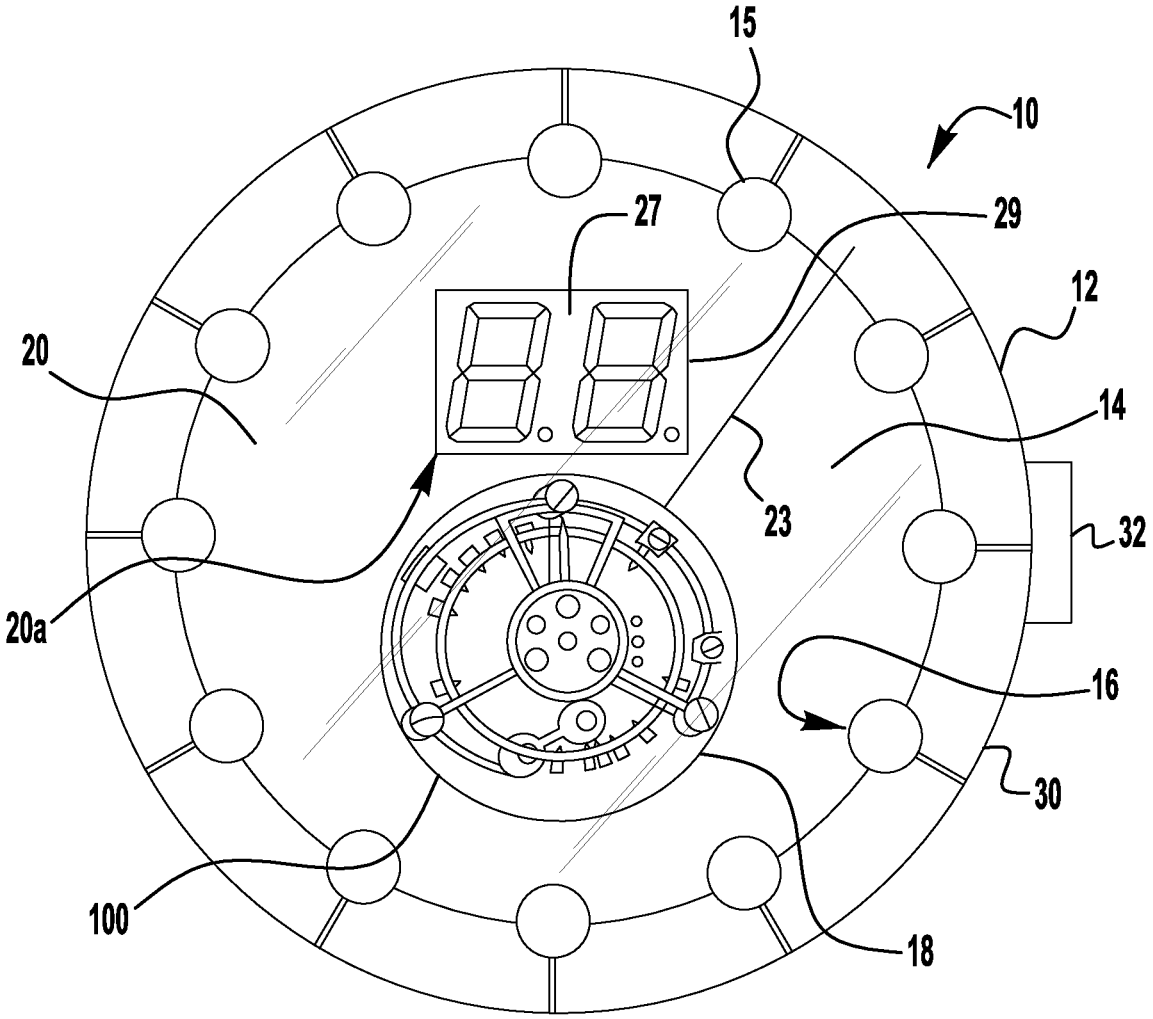

In the drawings accompanying the description that follows, often both reference numerals and legends (labels, text descriptions) will be used to identify elements. If legends are provided, they are intended merely as an aid to the reader, and should not in any way be interpreted as limiting.

FIG. 1 is a front view of a portion of a skeletonized electronic tourbillion simulator featured with a repeater, in accordance with the present invention.

Figure 2:
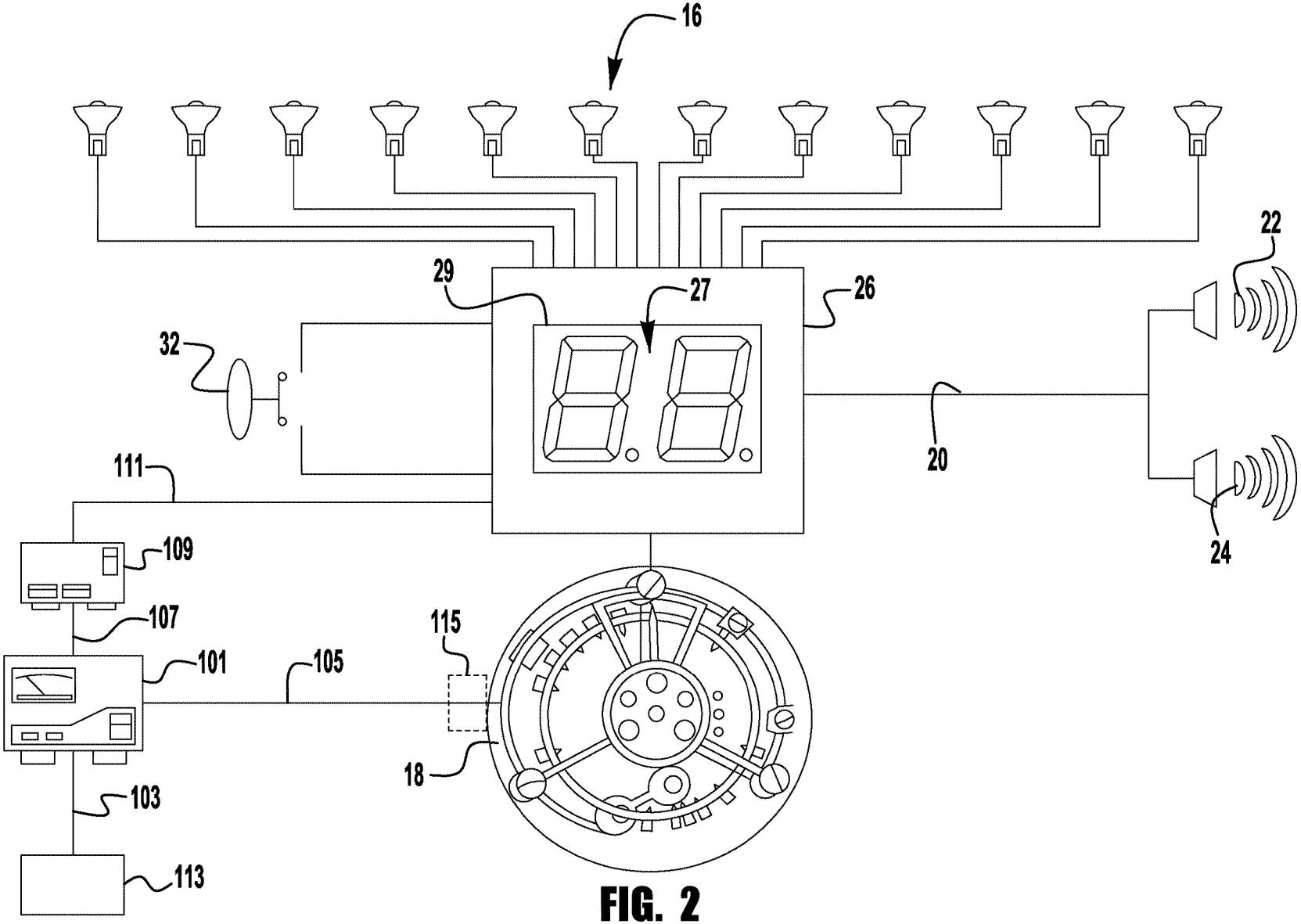

FIG. 2 is a view of the internally located components of a skeletonized electronic tourbillion simulator featured with a repeater and speakers, in accordance with the present invention.

Figure 3:
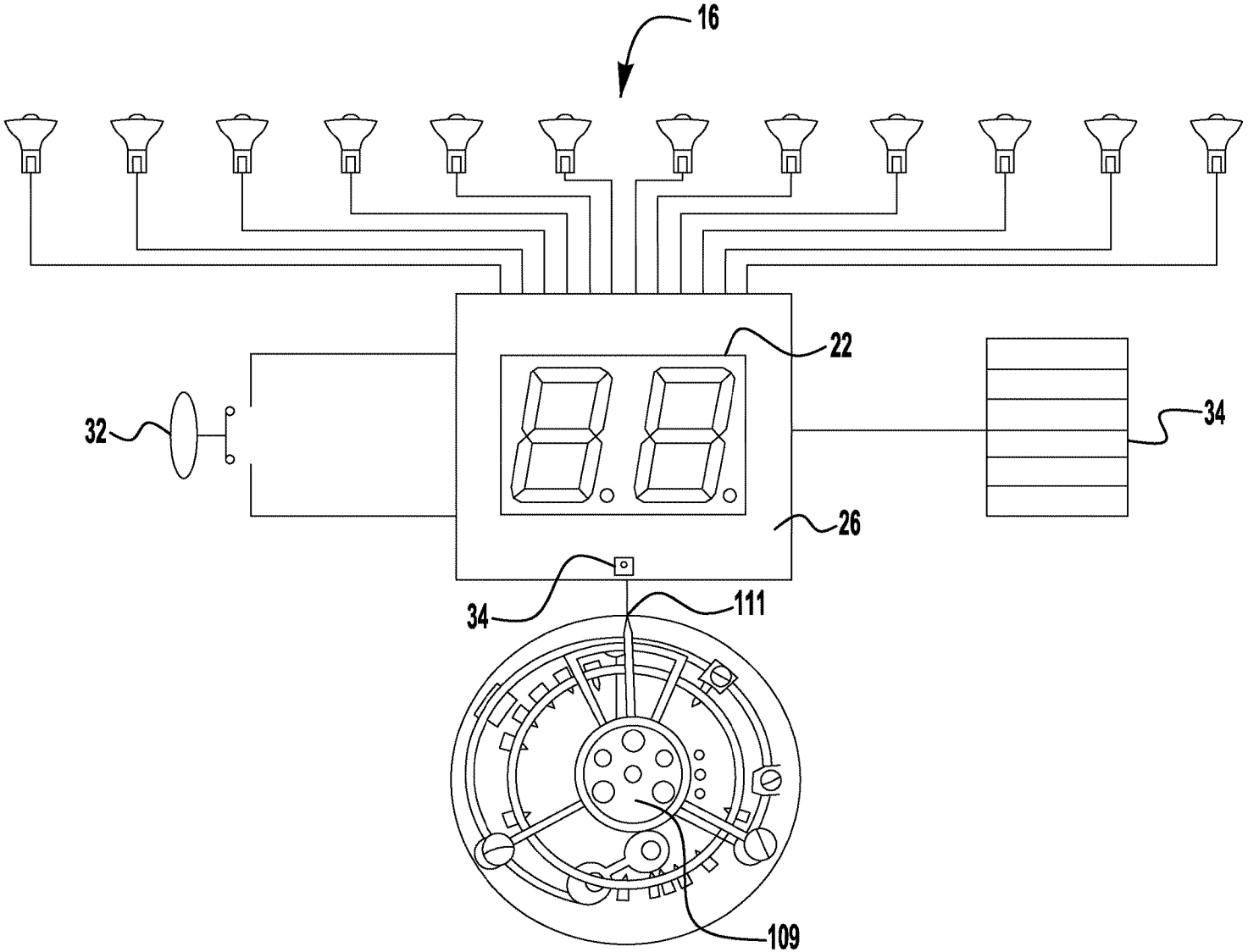

FIG. 3 is a view of a skeletonized electronic tourbillion simulator featured with a repeater and a sub-circuit, in accordance with the present invention.

Figure 4:
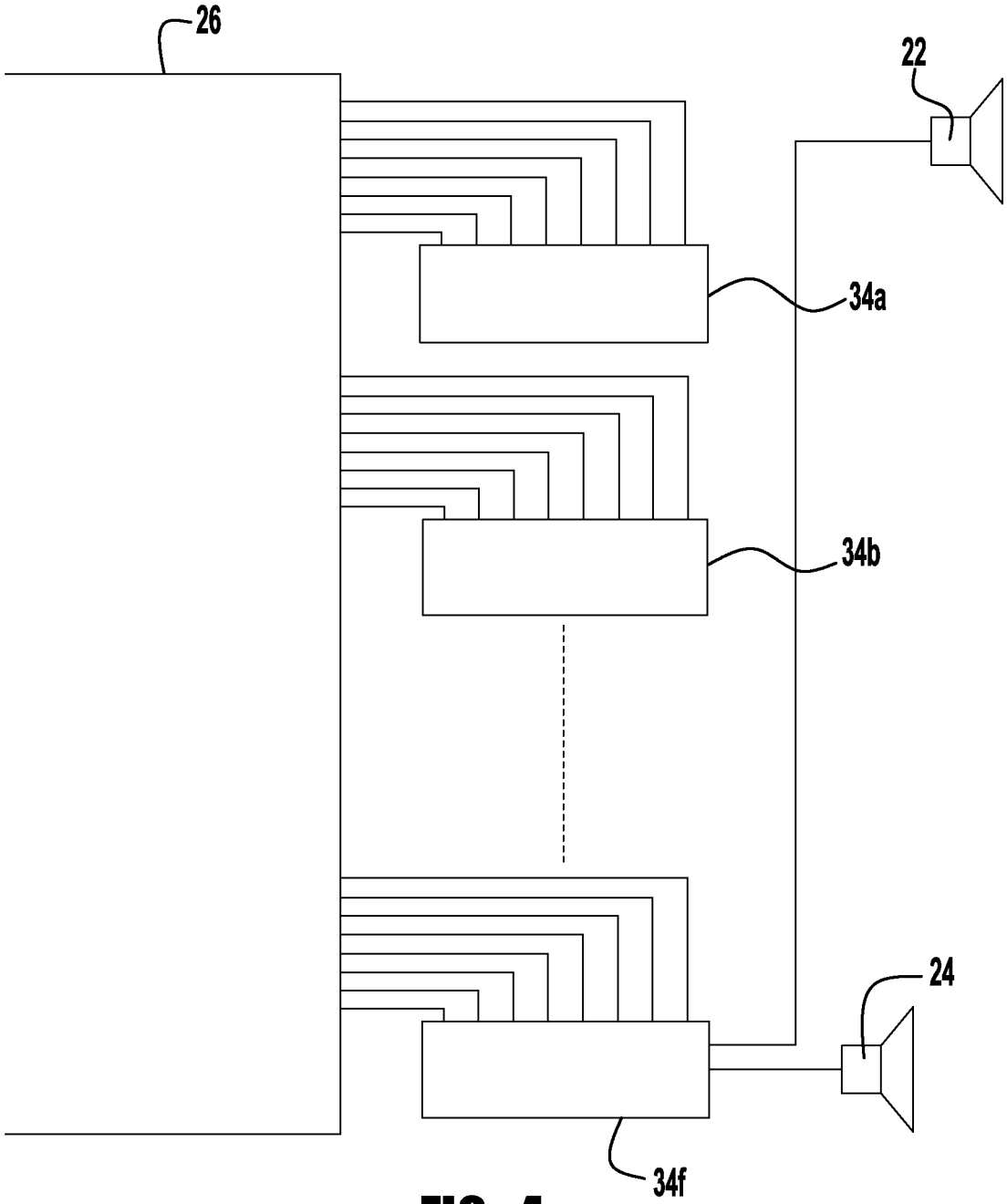

FIG. 4 is an illustration of the sub-surface interfaces mounted to a circuit board and speaker, in accordance with the present invention.

Figure 5:
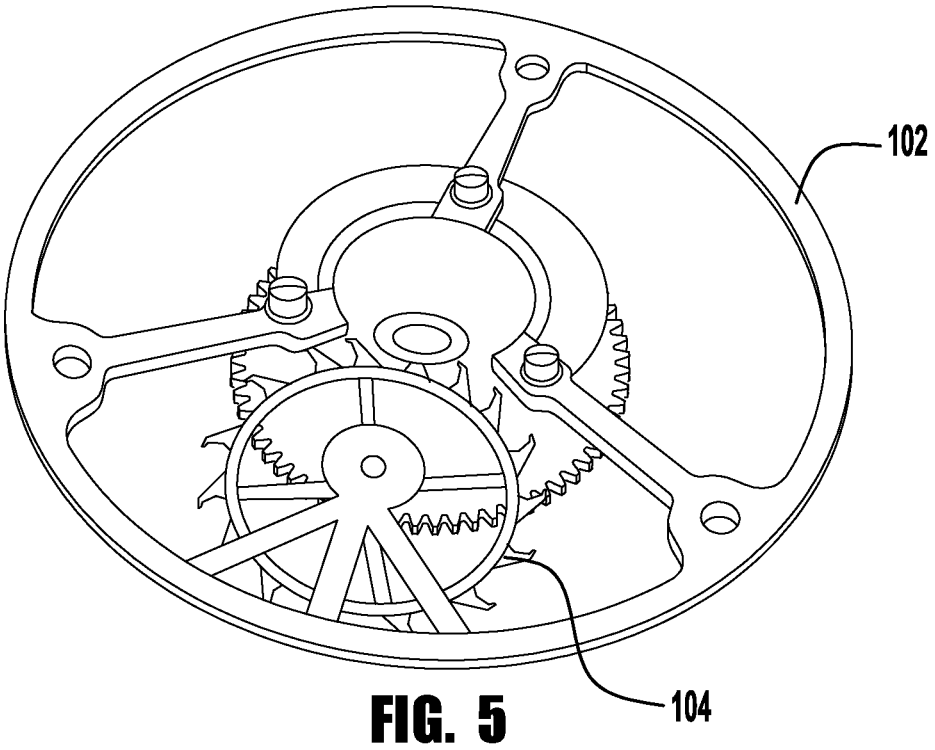

FIG. 5 is a three dimensional view of the carriage and escapement wheel of a skeletonized electronic tourbillion simulator, in accordance with the present invention.

Figure 6:
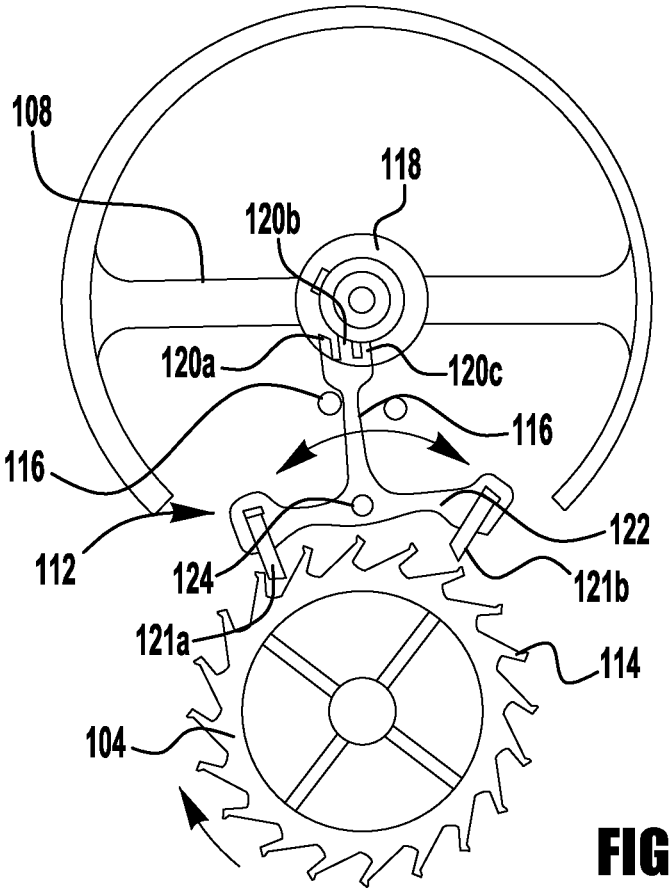

FIG. 6 is a top view of the escapement mechanism and the escapement mechanism of a skeletonized electronic tourbillion simulator, in accordance with the present invention.

Figure 7:
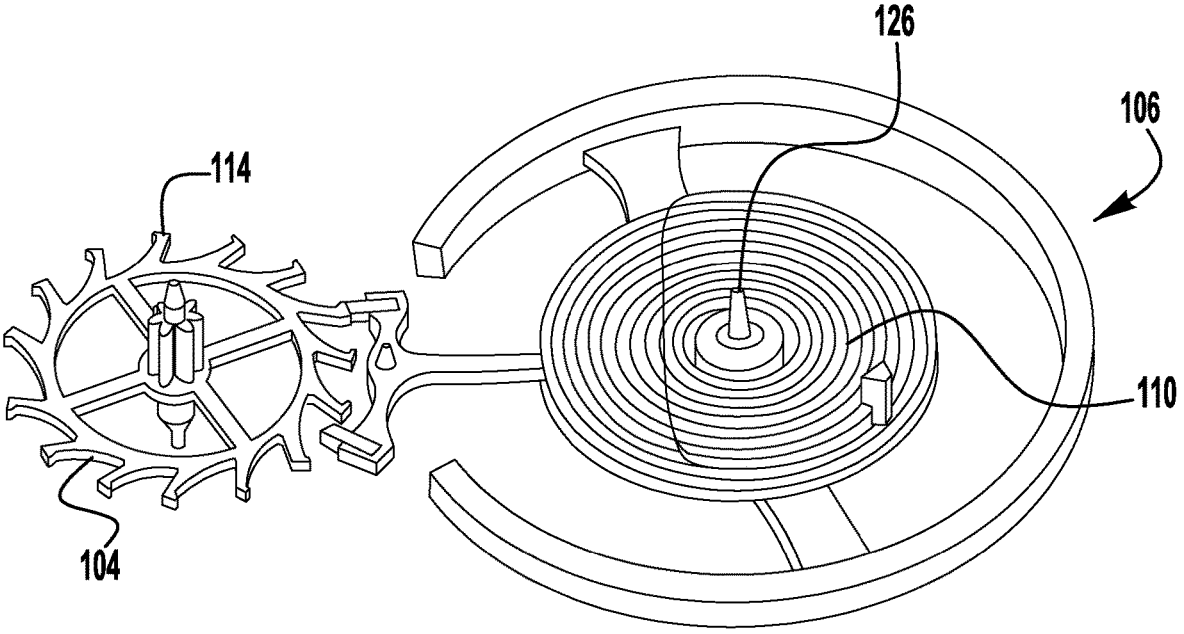

FIG. 7 is a three dimensional view of the escapement mechanism in combination with the balance wheel and hairspring of a skeletonized electronic tourbillion simulator, in accordance with the present invention.

Figure 8:
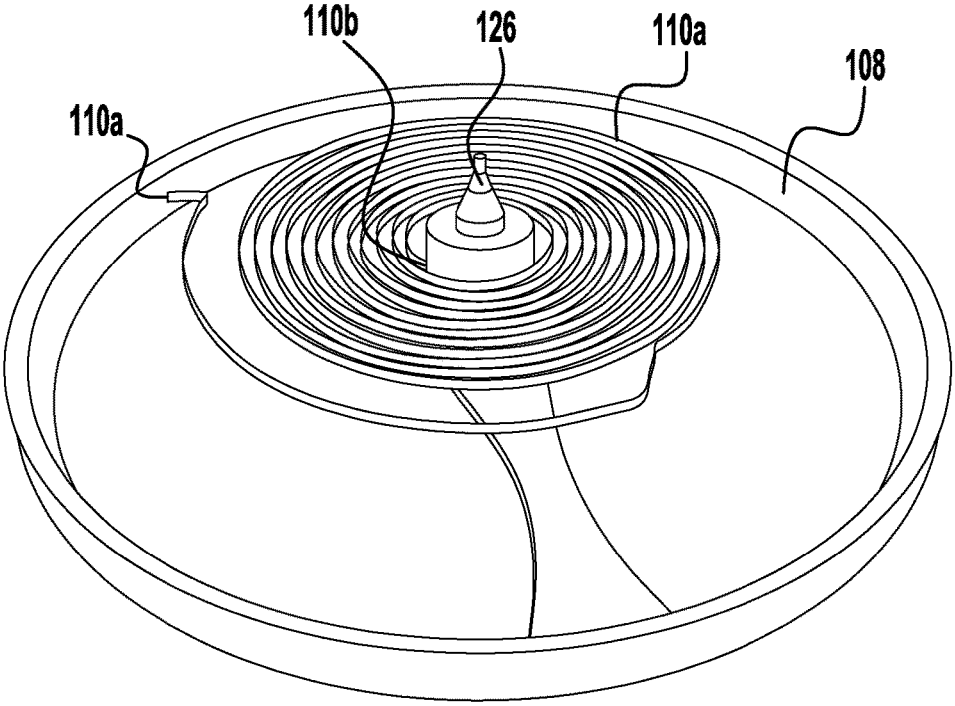

FIG. 8 is a three dimension view of the balance wheel and balance spring of a skeletonized electronic tourbillion simulator, in accordance with the present invention.

Figure 9:
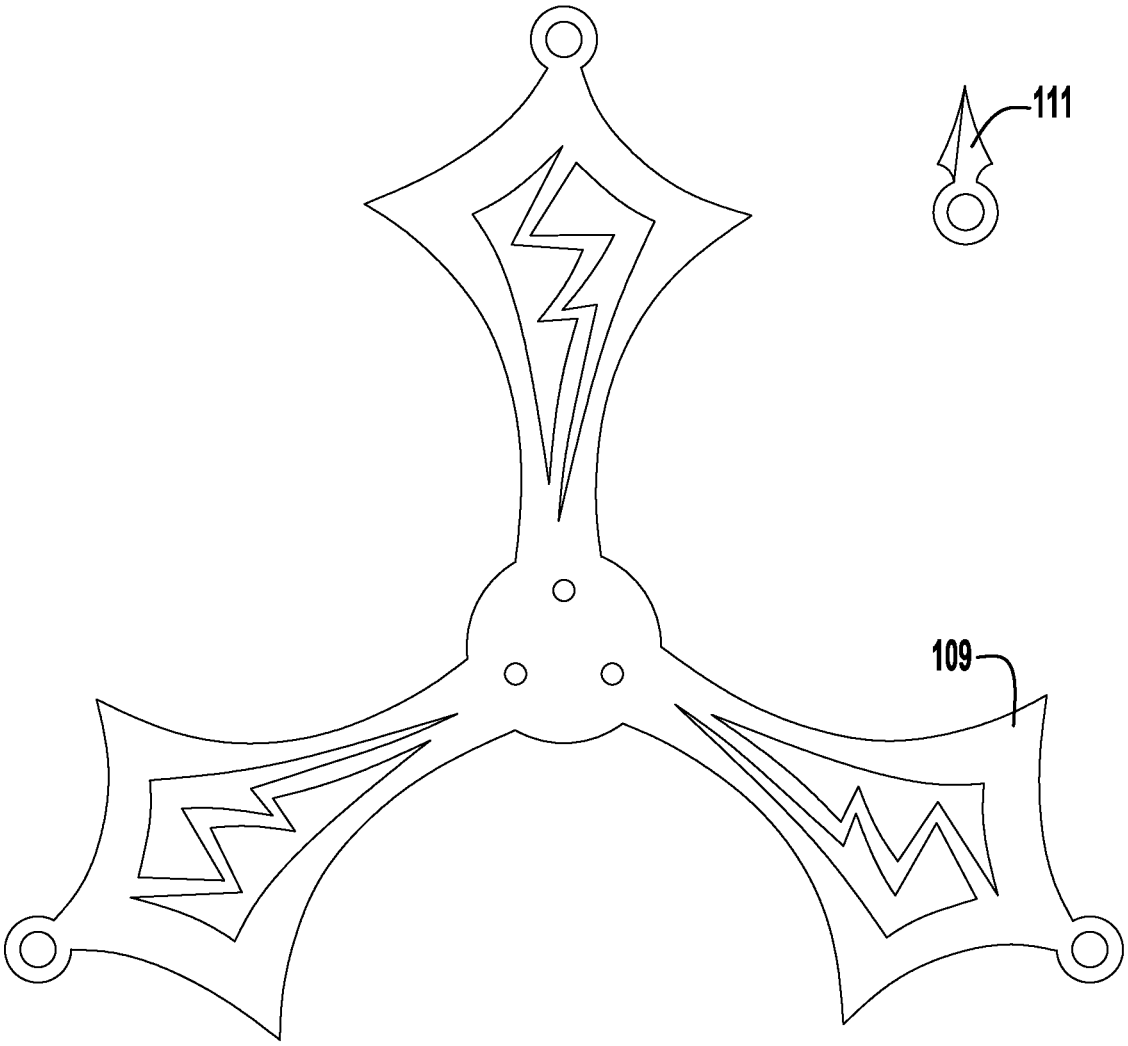

FIG. 9 is a top view of the upper carriage of a skeletonized electronic tourbillion simulator, in accordance with the present invention.

DETAILED DESCRIPTION OF THE PREFERRED EMBODIMENTS

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Referring to FIG. 1, there is illustrated an electronic tourbillion clock 10 according to the invention. It comprises, in this example, a clock case 12 housing a microcontroller 14 displaying indications on a high-resolution digital display 16 that extends around the outer circumference of the clock case 12 and thus serves both as a clock dial and as time indicator. In a preferred embodiment, the digital display 16 is constituted by a plurality of color liquid crystal displays (LCD) or a thin film transistor (TFT) with at least 150×150 pixels. Other types of displays, including light emitting diode (LED) displays based on organic light emitting diodes (OLED) technology for example, can be used. Furthermore, the clock 10 could also comprise several displays, for example several digital displays, or a digital matrix display combined with hands or other mechanical indicators.

The microcontroller 14 enables different applications to be executed, on the one hand in order to determine the current time and other chronological indications depending on the output signals generated by the position of a Tourbillon Mechanism 100 disposed in the clockcase 12 or by a clockhand turned by the Tourbillon Mechanism. There may be different microcontrollers for controlling the touch interface and a general microcontroller for determining the indications to be displayed at each instant. These different microcontrollers can also be grouped together differently.

The watch 10 can also include a sub-circuit 20, see FIG. 3, creating a plurality of distinctive sound patterns directed through a first and/or second speakers 22 and 24.

The Tourbillon Mechanism 100 may include any conventional tourbillon movement. The following description of the Tourbillon Mechanism 100 is an exemplary tourbillon mechanism that may be employed by the electronic tourbillion clock 10. The principle of a tourbillon mechanism for a timepiece has been well known for two centuries. It consists in forming an assembly comprising a carriage 102 which acts as the main frame that supports all the elements within, whereby all the elements are attached to it. While the entire mechanism 100 rotates, the escape wheel 104 undergoes a separate movement of its own, 360 degrees continuously, to drive the back and forth oscillation of the balance wheel 108.

In general terms, the tourbillon mechanism 100, as shown in FIGS. 5 and 7, for the electronic tourbillion clock 10 includes a balance mechanism 106 and an escapement mechanism 112 mounted in a lower carriage 102. The balance mechanism 106 includes a balance spring 110 and a balance wheel 108, as shown in FIG. 6, mounted to pivot inside the lower carriage 102. The balance spring 110, as shown in FIG. 8, is secured by a first end 110*a* directly to the balance wheel 108, and by its second end 110*b* to the carriage 102 so as to apply a relative elastic rotational force between the balance wheel and the carriage. The carriage has an upper carriage 109, as shown in FIG. 9, mounted to the lower carriage 102 as shown in FIG. 3. A pointer 111 is mounted to one end of the upper carriage so that it is spaced from the proximity sensor 34 whereby it turns and activates the 7 segment counter every time it passes the sensor.

The escapement mechanism 112 comprises an escape wheel 104 provided with teeth 114, a pallet-lever 116, and a roller device 118 coupled to the balance wheel 108. The pallet-lever 116 includes a fork 120, jewels 121 and a lever 122 connecting the jewels to the fork. The lever 122 is coupled in rotation to the carriage 102 by means of a pivot device 124 which will be described in more detail below. The jewels 121 cooperate with the escape wheel teeth 114. A first jewel 121*a* forms the entry pallet and a second jewel 121*b* forms the exit pallet. The pallet-lever 116 further includes a guard pin fixed to the fork 120 by means, for example, of a pin pressed in or bonded inside a securing hole at the base of the fork. The roller device 118 may a table roller with an impulse pin that engages the horns 120*a*, 120*b*, and 120*c* of the fork 120 and a small roller provided with a passing-hollow for the passage of the guard pin. As this principle is well known per se, the conventional elements and the operation thereof will not be described in more detail here.

The escape wheel teeth 114 point outwards from the escape wheel 104 and the jewels 121 are disposed radially on the outside of the escape wheel and point inwards, namely towards the axis of rotation 126 of the tourbillon carriage 100. The carriage 102 is mounted to rotate, by means of bearings, in a frame or fixed structure of the timepiece movement. The carriage 102 is connected to an energy source, such as motor (not shown), providing a rotational torque on the carriage. This energy source may be coupled to the carriage 102 by means of a drive train meshing with a pinion that is attached to or integral with the body of the carriage.

The component parts of the balance wheel 108 together with pallet-lever 116 of the escapement wheel 104 are carried by the carriage 102 and thus rotate with the carriage. The escape wheel 104 is attached to or integral with the frame or a fixed structure of the timepiece movement.

While the balance wheel 108 describes its arc of oscillation and one of the jewels 121 engages one tooth 114 of the escape wheel 104, the carriage 102 remains still, together with the escapement wheel and the drive train. Although the carriage 102 is subject to the drive force that acts on the carriage pinion, no rotation is possible because the pallet-lever 116, which is secured to the body of the carriage, is stopped against a tooth of the escape wheel which is in fixed relation with the frame.

As soon as a jewel 121 is released from an escape wheel tooth 114, the carriage turns through a small angle, and is immediately immobilized when the escapement functions end and one of jewels is again stopped against a tooth of the escape wheel. After this displacement, the assembly carried by the carriage 102 occupies a new locking position.

The balance wheel 108 is located inside and in the axis of rotation 126 of the carriage 102 and its pivots rotate in bearings integral with the carriage. As regards the other parts of the escapement, with the exception of the escape wheel 104, these parts pivot with the carriage. Thus, in a relatively short period of time, for example in one minute, in a series of jumps, the entire carriage 102 will have completed one revolution, driving with it all the members that it carries.

The tourbillion mechanism 100 can be driven by a 1 RPM motor (not shown) installed on the back of the carriage base. This motor is connected to a voltage regulator 101 which is powered through a line 103 receiving power from an AC power source 113. The voltage regulator 101 directs power to the motor 115 through line 105. Preferably, the motor 115 to be used is a synchron gear clock motor. The voltage regulator 101 directs regulated voltage through a line 107 to a DC power supply 109. In turn, the DC power supply 109 directs power though a line 111 to the main circuit board 26 and to the seven segment display 29.

The total weight of the tourbillion mechanism 100 will typically be less than 16 ounces, since a higher weight may burn out the motor. Thus, the electronic tourbillion clock 10 will generally utilize aluminum components when possible is desirable. Further, the tourbillion mechanism 100 must be mounted in a vertical orientation, and must be tested for stability during operation.

As seen in FIG. 1, the electronic tourbillion clock 10 includes a clock case 15 in which the components of the clock are housed. The clock case 15 may have any desirable dimensions, and typically constructed of stainless steel, although may be formed of any combination of plastic and metal. The clock case 15 may be supported to stand, such as with a pair of supporting legs to the underside thereof.

A watch dial 20 is disposed within the clock case 15, and is presented as the face of the clock 10. The watch dial 20 can include printed time markings, which are provided on the surface thereof. The printed time markings can be printed directly on the surface of the watch dial in a conventional manner. Alternatively, or in combination with printed time markings, the dial may be see-through to present the inner workings of the clock 10. Optionally, a brightness sensor, not represented, enables the intensity of the screen to be adapted automatically to the ambient luminosity. This sensor can also be used for adapting the intensity and direction of the shadows that are simulated and drawn on the display depending on the intensity and direction of ambient light. There is an external durable transparent glass 21 that is positioned over the watch dial 20 to represent the watch crystal.

As illustrated in FIG. 1, twelve LED bulbs 16 are secured within the watch dial 20, designed to act as hour indicators. The LED bulbs 16 are positioned within the clock case 15, surrounding a seven segment display 29 and custom sweeping hand 23. A main circuit board 26, housed within the clock case 15, holds the seven segment display 29, a programmable microchip 28, reset pins (not shown) and a push button trigger 32. The main circuit board 26 is interfaced with a sub-circuit 34 that holds multi-mode voice record and playback integrated circuits. The main circuit board 26 mechanically supports and electrically connects the components of the electronic tourbillion clock 10 using conductive tracks, pads and other features etched from one or more sheet layers of copper laminated onto and/or between sheet layers of a non-conductive substrate. The components may connected to the main circuit board 26 in any desirable practical method, such as soldering the components onto the circuit board to both electrically connect and mechanically fasten them to it.

The twelve LED bulbs 16 and seven segment display 29, illustrated in FIG. 1, are designed as a visual indication of the time. The twelve LED bulbs 16 act as hour indicators, and each bulb is situated in the location of a standard hour marker on a traditional clock face. The seven segment display 29 is located in a central area 20*a* of the watch dial 20. The display 29 is an indicator of the minutes elapsed within an hour. Therefore, the display 29 has two adjacent digital numbers displayed, depending on the time. For example, if the time is 4:27, only the fourth LED bulb 16*d* will be illuminated, and digits 27 will be represented within the seven segment display 29. The operation of the twelve LED bulbs 16 and the seven segment display 29 is controlled by the programmable microchip within the main circuit board 26. Reset pins (not shown) located on the back of the watch case 15, are utilized to program the time as is done with a traditional clock.

The electronic tourbillion clock 10 is unique in its ability to combine the traditional tourbillion mechanism 18 with the digital seven segment display 29 and twelve LED bulbs 16. A proximity sensor 34 is disposed directly above the custom sweeping hand 23. The proximity sensor 34 is a sensor able to detect the presence of a nearby object without any physical contact. The proximity sensor 34 emits an electromagnetic field or a beam of electromagnetic radiation (infrared, for instance), and looks for changes in the field or return signal. The object being sensed is often referred to as the proximity sensor's 34 target. In this situation, the tourbillion mechanism 18 incorporates an extended pointer 111, which operates as the proximity sensor's 34 target. Typically, the pointer measures 0.5 inches, although any desired length may be used.

The tourbillion mechanism 18 is driven by a precise 1 RPM motor 115 installed in the back of the carriage base. The tourbillion mechanism 18 must be tested for accuracy, with only a few second delay or advance within a 24-hour period. Every time the tourbillion mechanism 18 makes a clockwise rotation driven by the motor 115, the extended pointer 111 simultaneously rotates 360 degrees. The proximity sensor 34 then detects a change in distance indicated by the extended pointer 111 of the tourbillion mechanism 18. This results in an increase in the seven segment display 29 by a one minute increment. In turn, the seven segment display 29 triggers a change in an LED bulb display 16 by one level, which is equivalent to a one hour increment, as soon the seven segment display 29 reaches a 00 reading. For example, if the seven segment display 29 reads 59, after the extended pointer 111 rotates 360 degrees, the following LED bulb display 16 will be illuminated and the previously illuminated LED bulb will turn off at the same time.

The electronic tourbillion clock 10 further includes dual speakers 22 and 24 to provide sound based on the time of the clock. The tourbillion clock 10 includes a push button trigger 32 on the exterior of clock case 15. The push button trigger 32 incorporates extended wires connected to the main circuit board 26 and activates an audible representation of the time upon being triggered. When triggered, the main circuit board 26 that carries the built-in programmed microchip 28 will identify a targeted zone 34, as seen in FIG. 3, based on the current time display. From a large number of zones present in the sub-circuit 34, each one contains a multi-mode voice record and playback integrated circuit that stores distinctive sets of sounds emitted through the dual speakers 22 and 24.

The targeted zones 34, illustrated in FIG. 3, indicate the tones that will emit from the dual speakers dual speakers 22 and 24. There are six possible zone settings, 34*a*, 34*b*, 34*c*, 34*d*, 34*e*, and 34*f*, which determine the sounds emitting from the speakers 22 and 24. Zone 34*a* is an hour repeater, zone 34*b* is a quarter repeater, zone 34*c* is a ten minute repeater, zone 34*d* is a five minute repeater, zone 34*e* is a minute repeater and zone 34*f* is a decimal repeater. Based on the zone 34 determined by the user, a different set of chimes will emit based on the time displayed by the electronic tourbillion clock 10.

For example, if zone 34*a* is selected, when the push button trigger 32 is triggered, one chime sound will emit which will depend on what hour of the day it is. As such, by way of example, the 1:00 hour will have a distinct chime, the 2:00 hour will have a second distinct chime, the 3:00 hour will have a third distinct chime, and so on. There is a total of 12 possible chime sounds for a 12 hour display.

If zone 34*b* is selected, when the push button trigger 32 is triggered, one chime sound will emit which will depend on what hour of the day it is, and a second chime will emit based on what 15-minute segment of the clock face it is. As such, by way of example, 1:00 will have a distinct chime, 1:17 will have a second distinct chime, the 1:33 will have a third distinct chime, and 1:47 will have a fourth distinct chime. There is a total of 48 possible chime sounds for a 12 hour display, which includes 12 hours times 4 quarters per hour.

If zone 34*c* is selected, when the push button trigger 32 is triggered, one chime sound will emit which will depend on what hour of the day it is, and a second chime will emit based on what 10-minute segment of the clock face it is. As such, by way of example, 1:00 will have a distinct chime, 1:17 will have a second distinct chime, the 1:33 will have a third distinct chime, 1:47 will have a fourth distinct chime, and so on. There is a total of 72 possible chime sounds for a 12 hour display, which includes 12 hours times 6 ten minute segments per hour.

If zone 34*d* is selected, when the push button trigger 32 is triggered, one chime sound will emit which will depend on what hour of the day it is, and a second chime will emit based on what 5-minute segment of the clock face it is. As such, by way of example, 1:00 will have a distinct chime, 1:06 will have a second distinct chime, the 1:11 will have a third distinct chime, 1:16 will have a fourth distinct chime, and so on. There is a total of 144 possible chime sounds for a 12 hour display, which includes 12 hours times 12 five minute segments per hour.

If zone 34*e* is selected, when the push button trigger 32 is triggered, one chime sound will emit which will depend on what hour of the day it is, and a second chime will emit based on what 1-minute segment of the clock face it is. As such, by way of example, 1:00 will have a distinct chime, 1:06 will have a second distinct chime, the 1:11 will have a third distinct chime, 1:16 will have a fourth distinct chime, and so on. There is a total of 720 possible chime sounds for a 12 hour display, which includes 12 hours times 60 one minute segments per hour.

If zone 34*f* is selected, when the push button trigger 32 is triggered, one chime sound will emit which will depend on what hour of the day it is, and a second chime will emit based on what 1-minute segment of the clock face it is. As such, by way of example, 1:00 will have a distinct chime, 1:06 will have a second distinct chime, the 1:11 will have a third distinct chime, 1:16 will have a fourth distinct chime, and so on. There is a total of 720 possible chime sounds for a 12 hour display, which includes 12 hours times 60 one minute segments per hour.

The electronic tourbillion clock 10 further includes a sweeping hand 23, and an associated set of mechanisms to operate the sweeping hand. The sweeping hand 23 and mechanism is not an essential aspect of the electronic tourbillion clock 10, but rather serves as an aethetic feature. The functions of the microchip 28 are not affected by the sweeping hand 23, nor is the chiming mechanism as relates to the zones 44.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An electronic tourbillion clock, comprising;

a clock case having a plurality of high-resolution digital displays that extend around an outer circumference of the clock case as an indicator of hours;

a seven segment display located within the clock case as an indicator of minutes elapsed within an hour;

a microcontroller determining the current time and other chronological indications depending on the output signals generated by a position of a tourbillon mechanism disposed in the clock case; and a sub-circuit in the clock case and interconnected with the microcontroller for creating a plurality of distinctive sound patterns directed through one or more speakers in response to the output signals generated by the position of the tourbillon mechanism.

2. The electronic tourbillion clock of claim 1, wherein the plurality of digital displays are constituted by a twelve color liquid crystal displays.

3. The electronic tourbillion clock of claim 1, wherein the plurality of digital displays are constituted by a twelve color light emitting diode displays.

4. The electronic tourbillion clock of claim 3, wherein the twelve color liquid crystal displays include twelve bulbs secured within the watch dial, and provided to act as hour indicators.

5. The electronic tourbillion clock of claim 1, wherein a main circuit board housed within the clock case is interfaced with the sub-circuit and supports the seven segment display, a programmable microchip, and a push button trigger.

6. The electronic tourbillion clock of claim 1, wherein the tourbillon mechanism disposed in the clock case comprises a balance mechanism and an escapement mechanism mounted in a lower carriage.

7. The electronic tourbillion clock of claim 6, wherein a pointer is mounted to one end of an upper carriage of the tourbillon mechanism so that it is spaced adjacent a proximity sensor mounted to the main circuit board and wherein the proximity sensor activates the seven segment display every time the pointer rotates past the proximity sensor.

8. The electronic tourbillion clock of claim 7, further including a motor installed on the lower carriage for rotating the tourbillion mechanism and the pointer, whereby the rotation of the motor drives the pointer past the proximity sensor.

9. The electronic tourbillion clock of claim 8, wherein the motor installed on the lower carriage for rotating the tourbillion mechanism and the pointer rotates at one revolution per minute whereby the whereby tourbillion mechanism and the pointer rotates past the proximity sensor one time per minute.

10. The electronic tourbillion clock of claim 9 wherein the motor is connected to an AC power source.

11. The electronic tourbillion clock of claim 1, further including a watch dial disposed within the clock case 15, and presented as a face of the clock, including printed time markings, which are provided on the surface thereof.

12. The electronic tourbillion clock of claim 11, further including an external durable transparent glass that is positioned over the watch dial to form the watch crystal.

13. A method of operating an electronic tourbillion clock, including;

rotating a tourbillion mechanism in a clockwise direction;

simultaneously rotating an extended pointer mounted to the tourbillion mechanism in a clockwise direction;

detecting a change in distance within a proximity sensor from the extended pointer to the proximity sensor and directing a signal to a seven segment display;

increasing a number generated on the seven segment display by one minute increments in response to the signal directed by the proximity sensor to the seven segment display;

triggering a change in a bulb display by one hour increments whenever the seven segment display reaches a 00 reading; and creating a plurality of distinctive sound patterns and directing the sound patterns through one or more speakers in response to output signals generated by a sub-circuit, interconnected with a microcontroller mounted within the electronic tourbillion clock.

14. The method of claim 13, further including housing a main circuit board within a clock case and interfacing the main circuit board with the sub-circuit, thereby supporting the seven segment display, a programmable microchip, and a push button trigger.

15. The method of claim 14, further including activating an audible representation of the time upon triggering the push button trigger.

16. The method of claim 15, further including identifying a targeted zone based on the current time display and the sub-circuit generating a signal to one or more speakers through which an distinctive set of sounds is emitted.

17. The method of claim 16, further including mounting the extended pointer to one end of an upper carriage of the tourbillon mechanism, and spacing the extended pointer adjacent the proximity sensor mounted to the main circuit board.

18. The method of claim 17, further including rotating the tourbillion mechanism and the extended pointer with a motor and driving the extended pointer past the proximity sensor.

19. The method of claim 18, further including rotating the tourbillion mechanism and the extended pointer at one revolution per minute whereby the whereby tourbillion mechanism and the pointer rotates past the proximity sensor one time per minute.

20. The method of claim 19, further including connecting the motor to an AC power source.

* * * * *